US006614156B2

(12) United States Patent
Oda et al.

(10) Patent No.: US 6,614,156 B2
(45) Date of Patent: Sep. 2, 2003

(54) CATHODE-RAY TUBE APPARATUS

(75) Inventors: Hiroyuki Oda, Fukaya (JP); Junichi Kimiya, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 222 days.

(21) Appl. No.: 09/934,857

(22) Filed: Aug. 23, 2001

(65) Prior Publication Data

US 2002/0024284 A1 Feb. 28, 2002

(30) Foreign Application Priority Data

Aug. 24, 2000 (JP) ..... 2000-253882

(51) Int. Cl.[7] ..... H01J 29/50

(52) U.S. Cl. ..... 313/414; 313/413; 313/426; 315/370; 315/382; 315/382.1

(58) Field of Search ..... 313/413, 414, 313/417, 421, 426, 456, 458, 452, 314; 315/3, 5.24, 364, 368.12, 368.24, 382, 382.1, 383, 370

(56) References Cited

U.S. PATENT DOCUMENTS 5,977,726 A * 11/1999 Shishido ..... 315/382

FOREIGN PATENT DOCUMENTS

JP 10-334827 12/1998

* cited by examiner

*Primary Examiner*—Ashok Patel
*Assistant Examiner*—Jason R Phinney
(74) *Attorney, Agent, or Firm*—Oblon, Spivak, McClelland, Maier & Neustadt, P.C.

(57) ABSTRACT

A main lens section of an electron gun assembly includes a focus electrode supplied with a focus voltage of a first level, a dynamic focus electrode supplied with a dynamic focus voltage obtained by superimposing an AC component, which varies in synchronism with deflection magnetic fields, upon a reference voltage close to the first level, and an anode supplied with an anode voltage with a second level higher than the first level. The electron gun assembly further includes at least two auxiliary electrodes disposed between the focus electrode and the dynamic focus electrode, and these at least two auxiliary electrodes are connected via a resistor disposed near the electron gun assembly.

10 Claims, 4 Drawing Sheets

CATHODE-RAY TUBE APPARATUS

CROSS-REFERENCE TO RELATED APPLICATIONS

This application is based upon and claims the benefit of priority from the prior Japanese Patent Application No. 2000-253882, filed Aug. 24, 2000, the entire contents of which are incorporated herein by reference.

BACKGROUND OF THE INVENTION

1. Field of the Invention

The present invention relates to a cathode-ray tube (CRT) apparatus, and more particularly to a color cathode-ray tube apparatus with an electron gun assembly capable of performing dynamic astigmatism compensation.

2. Description of the Related Art

In these years, self-convergence in-line type color CRT apparatuses, each of which can self-converge three in-line electron beams on the entire area of a phosphor screen, have widely been used. In this type of color CRT apparatus, an electron beam, which has passed through a non-uniform magnetic field, suffers deflection aberration. As is shown in FIG. 1A, for example, an electron beam 12 receives a force in the direction of arrows 13 due to a pin-cushion-shaped horizontal deflection magnetic field 11. Consequently, as shown in FIG. 1B, the beam spot 12 of the electron beam deflected onto a peripheral portion of the phosphor screen deforms, thus seriously degrading the resolution.

Owing to the deflection aberration suffered by the electron beam, the electron beam is vertically over-focused while it is horizontally spread. As a result, the beam spot on the peripheral portion of the phosphor screen has a horizontally deformed core portion 14 with high luminance and a vertically spread halo portion 15 with low luminance.

There are known some means for solving the problem of degradation in resolution. For example, electron gun assemblies have a common structure comprising first to fifth grids. The electron gun assembly includes an electron beam generating section, a quadrupole lens, and a main lens, which are formed along the axis of travel of electron beams. The quadrupole lens is composed of the third and fourth grids disposed adjacent to each other. The third and fourth grids, respectively, have three vertically elongated non-circular electron beam passage holes and three horizontally elongated non-circular electron beam passage holes in their mutually opposing surfaces.

FIG. 2 shows an equivalent optical model for illustrating correction of deflection aberration by the electron gun assembly. When the quadrupole lens is not made to function, an electron beam 800 travels through a main lens 803 and a deflection magnetic field 804, as indicated by broken lines. The electron beam 800 deflected on a peripheral portion 805 of the phosphor screen is horizontally under-focused and vertically over-focused. Consequently, the resolution greatly deteriorates.

When the quadrupole lens is made to function, the effect of deflection aberration due to the deflection magnetic field 804 is decreased, as indicated by solid lines. An electron beam 801 deflected on the peripheral portion 805 of the phosphor screen creates a beam spot with a suppressed halo portion.

Even if the above correction means is provided, however, the deflection aberration due to the deflection magnetic field is very serious. Although the halo portion of the beam spot may be eliminated, the horizontal deformation of the core portion cannot be corrected. This occurs mainly due to the difference in incidence angle between horizontal and vertical directions of the electron beam that strikes the phosphor screen.

Specifically, the electron beam is affected differently in the horizontal and vertical directions owing to the quadrupole lens and deflection magnetic field. Thus, the horizontal incidence angle ax << the vertical incidence angle ay. As a result, the horizontal magnification Mx >> the vertical magnification My, according to the law of Lagrange-Helmholz. Consequently, the beam spot of the electron beam focused on the peripheral portion of the phosphor screen is horizontally deformed.

There are known some color CRT apparatuses capable of correcting the horizontal deformation. An electron gun assembly applied to these CRT apparatuses basically comprises first to seventh grids and includes an electron beam generating section, a first quadrupole lens, a second quadrupole lens and a main lens, which are arranged in the direction of travel of electron beams. The first quadrupole lens is formed by providing the third and fourth grids, which are disposed adjacent to each other, with three horizontally elongated non-circular electron beam passage holes and three vertically elongated noncircular electron beam passage holes in their mutually opposing surfaces. The second quadrupole lens is formed by providing the fifth and sixth grids, which are disposed adjacent to each other, with three vertically elongated non-circular electron beam passage holes and three horizontally elongated non-circular electron beam passage holes in their mutually opposing surfaces.

The lens action of the first quadrupole lens varies in synchronism with the variation in the deflection magnetic field, thereby correcting the image magnification of the electron beam incident on the main lens. The lens actions of the second quadrupole lens and the main lens vary in synchronism with the variation in the deflection magnetic field, thereby preventing the electron beam, which will ultimately be deflected on the peripheral portion of the phosphor screen, from being greatly deformed by the deflection aberration due to the deflection magnetic field.

FIG. 3 shows an equivalent optical model for illustrating correction of deflection aberration by the electron gun assembly. Specifically, a first quadrupole lens 901 controls the image magnification of an electron beam 900 incident on a main lens 903. A second quadrupole lens 902 varies the focus condition of the main lens 903, thus correcting deflection aberration due to a deflection magnetic field 904 and focusing the electron beam 900 on a peripheral portion 905 of the phosphor screen. Thereby, compared to a conventional dynamic focus electron gun assembly with a single quadrupole lens, the horizontal deformation can be eliminated and the electron beam can be focused on the peripheral portion of the phosphor screen more appropriately.

The use of the above-described double quadrupole lens structure, however, increases the incident angle in the horizontal direction, at which the electron beam to be focused on the peripheral portion of the phosphor screen enters the main lens section. Thus, the electron beams becomes more susceptible to the effect of spherical aberration of the main lens. In short, the beam spot at the peripheral portion of the phosphor screen has a horizontal halo portion.

Compared to the structure shown in FIG. 2 wherein the quadrupole lens is disposed in front of the main lens, the structure shown in FIG. 3, wherein the double quadrupole lenses are disposed in front of the main lens, has the following problem: the trajectory of the electron beam varies both in the horizontal and vertical directions. This requires optimization of the shape of the first quadrupole lens, optimization of the shape of the second quadrupole lens, and re-designing of the main lens system.

In general terms, the dynamic focus electron gun assembly performs focus adjustment by adjusting an external voltage. In the case of the structure shown in FIG. 2, the optimal focus adjustment can be made by varying the quadrupole lens 802 and main lens 803. However, in the case of the structure shown in FIG. 3, the focus adjustment is affected by the variation of the first quadrupole lens 901, second quadrupole lens 902 and main lens 903. As a result, the lens functions are complicated, and it is difficult to set an optimal focus voltage.

Moreover, in the case of the structure shown in FIG. 3, the shape of the electron beam passage hole formed in each of the electrodes constituting the first quadrupole lens differs from the shape of other holes. Consequently, in the electron gun assembling steps, center rods 52, 53 and 54 of an electron gun assembling jig 51 shown in FIG. 4 may not fit in the electron gun passage holes of the electrodes. This requires re-designing of the jig.

BRIEF SUMMARY OF THE INVENTION

The present invention has been made in consideration of the above problems, and the object of this invention is to provide a cathode-ray tube apparatus having an electron gun assembly, which requires no re-designing of a main lens system, can easily perform focus adjustment, requires no re-designing of a jig at the time of assembling an electron gun, and can obtain good image characteristics over the entire area of a phosphor screen.

In order to solve the problems and achieve the object, a cathode-ray tube apparatus of claim 1 comprises: an electron gun assembly including an electron beam generating section which generates an electron beam, and a main lens section which focus an electron beam generated from the electron beam generating section onto a phosphor screen; and a deflection yoke which generates deflection magnetic fields for deflecting and scanning the electron beam emitted from the electron gun assembly in a horizontal direction and a vertical direction, wherein the electron gun assembly includes a focus electrode supplied with a focus voltage of a first level and constituting a part of the main lens section, a first dynamic focus electrode supplied with a dynamic focus voltage obtained by superimposing an AC component, which varies in synchronism with the deflection magnetic fields, upon a reference voltage close to the first level, and constituting a part of the main lens section, a second dynamic focus electrode supplied with the dynamic focus voltage and disposed in a front stage of the main lens section, and an anode supplied with an anode voltage with a second level higher than the first level, at least two auxiliary electrodes are disposed adjacent to the second dynamic focus electrode, the at least two auxiliary electrodes are connected via a resistor disposed near the electron gun assembly, and the focus electrode and the first dynamic focus electrode are disposed adjacent to each other.

A cathode-ray tube apparatus of claim 3 comprises: an electron gun assembly including an electron beam generating section which generates an electron beam, and a main lens section which focus an electron beam generated from the electron beam generating section onto a phosphor screen; and a deflection yoke which generates deflection magnetic fields for deflecting and scanning the electron beam emitted from the electron gun assembly in a horizontal direction and a vertical direction, wherein the main lens section of the electron gun assembly includes a focus electrode supplied with a focus voltage of a first level, a dynamic focus electrode supplied with a dynamic focus voltage obtained by superimposing an AC component, which varies in synchronism with the deflection magnetic fields, upon a reference voltage close to the first level, and an anode supplied with an anode voltage with a second level higher than the first level, the electron gun assembly further includes at least two auxiliary electrodes disposed between the focus electrode and the dynamic focus electrode, and the at least two auxiliary electrodes are connected via a resistor disposed near the electron gun assembly.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the cathode-ray tube (CRT) apparatus according to the present invention will now be described with reference to the accompanying drawings.

Figure 5:
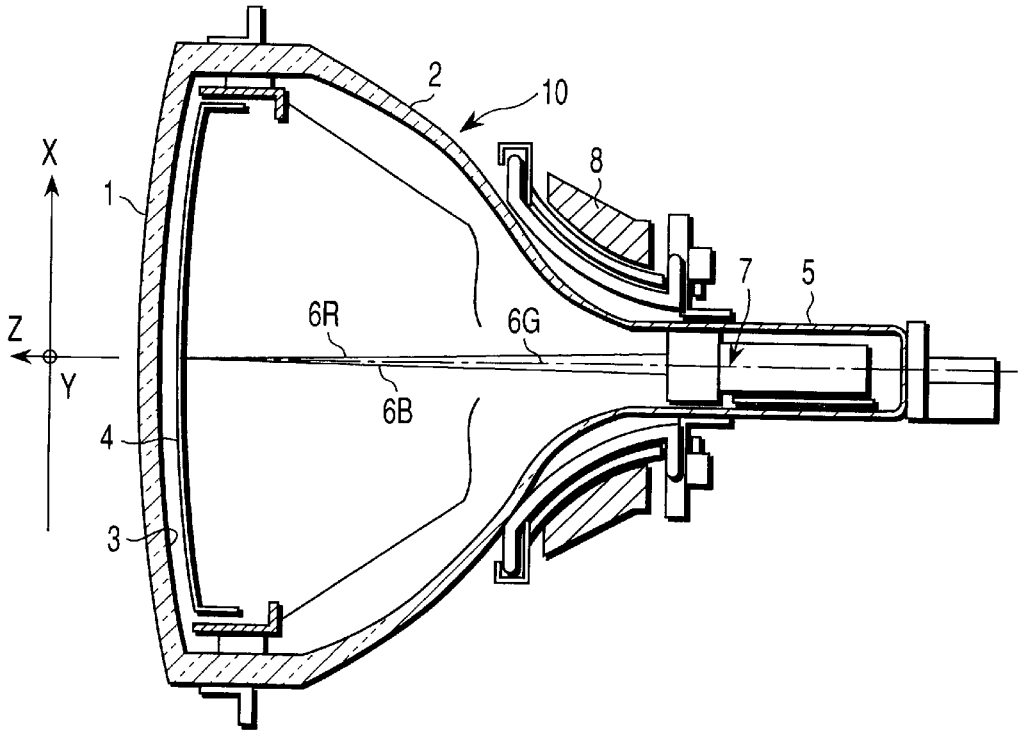
FIG. 5 is a horizontal cross-sectional view schematically showing the structure of a color CRT apparatus according to an embodiment of the CRT apparatus of the present invention.

As is shown in FIG. 5, the CRT apparatus of the present invention, for example, a color CRT apparatus, has an envelope 10 comprising a panel 1, a neck 5 and a funnel 2 for integrally coupling the panel 1 and neck 5. The panel 1 has, on its inner surface, a phosphor screen 3 (target) composed of striped or dot-like three-color phosphor layers which emit blue (B), green (G) and red (R). A shadow mask 4 is disposed to be opposed to the phosphor screen 3. The shadow mask 4 has a great number of apertures on its inside.

The neck 5 includes an in-line type electron gun assembly 7. The electron gun assembly 7 emits in a tube axis direction Z three in-line electron beams 6B, 6G and 6R, namely, a center beam 6G and a pair of side beams 6B and 6R, which travel in the same horizontal plane and are arranged in a horizontal direction X. The in-line type electron gun assembly 7 self-converges the three electron beams on a central portion of the phosphor screen 3 by biasing center positions of side beam passage holes in a low-voltage side grid and a high-voltage side grid of a main lens section.

A deflection yoke 8 is mounted on the outside of the funnel 2. The deflection yoke 8 generates non-uniform deflection magnetic fields for deflecting the three electron beams 6B, 6G and 6R emitted from the electron gun assembly 7 in a horizontal direction X and a vertical direction Y. The non-uniform deflection magnetic fields comprise a pin-cushion-shaped horizontal deflection magnetic field and a barrel-shaped vertical deflection magnetic field.

The three electron beams 6B, 6G and 6R emitted from the electron gun assembly 7 are focused on the associated phosphor layers on the phosphor screen 3, while being self-converged toward the phosphor screen 3. The three electron beams 6B, 6G and 6R are caused by the non-uniform deflection magnetic fields to scan the phosphor screen 3 in the horizontal direction X and vertical direction Y. Thereby, color images are displayed.

Figure 6:
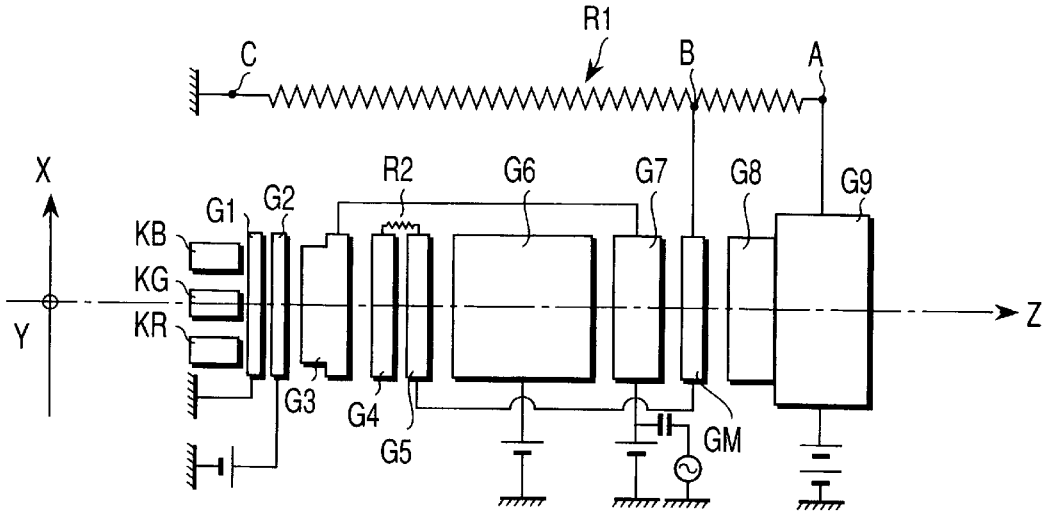
FIG. 6 is a horizontal cross-sectional view schematically showing a structure of an electron gun assembly applied to the CRT apparatus shown in FIG. 5.

As is shown in FIG. 6, the electron gun assembly 7 applied to the CRT apparatus comprises three cathodes K (R, G, B) arranged in line in the horizontal direction X, which accommodate heaters respectively; a first grid G1; a second grid G2; a third grid G3 (second dynamic focus electrode); a fourth grid G4 (first auxiliary electrode); a fifth grid G5 (second auxiliary electrode); a sixth grid G6 (focus electrode); a seventh grid G7 (first dynamic focus electrode); an intermediate electrode GM; an eighth grid G8 (anode); and a convergence cup G9. The three cathodes K and nine grids are successively arranged in the direction of travel of electron beams in the named order and are supported and fixed by an insulating support (not shown). The convergence cup G9 is fixed to the eighth grid G8 by welding. The convergence cup G9 is equipped with four contact portions for establishing electrical contact with an internal conductive film formed to extend from the inner surface of the funnel 2 to the inner surface of the neck 5.

A voltage of about 100V to about 150V is applied to the three cathodes K (R, G, B). The first grid G1 is grounded (or supplied with a negative potential V1). The second grid G2 is supplied with a low-potential acceleration voltage. This acceleration voltage is about 600V to about 800V.

The third grid G3 and seventh grid G7 are connected within the tube and supplied with a dynamic focus voltage from the outside of the CRT. This dynamic focus voltage is obtained by superimposing an AC component, which varies in synchronism with the deflection magnetic field, upon a reference voltage that is a focus voltage of about 6 kV to 9 kV.

The sixth grid G6 is supplied with a focus voltage of about 6 kV to 9 kV from the outside of the CRT. The eighth grid G8 and convergence cup G9 are supplied with an anode voltage of about 25 kV to 30 kV from the outside of the CRT.

As is shown in FIG. 6, a resistor R1 is provided near the electron gun assembly 7. The resistor R1 is connected at one end A to the convergence cup G9 and grounded at the other end C. An intermediate portion B of the resistor R1 is connected to the intermediate electrode GM. Thereby, the intermediate electrode GM is supplied with a voltage that is about 50% to 70% of a voltage supplied to the eighth grid G8.

The fifth grid G5 is connected to the intermediate electrode GM within the tube and, like the intermediate electrode GM, supplied with a voltage that is about 50% to 70% of the voltage supplied to the eighth grid G8. The fourth grid G4 is connected to the fifth grid G5 via a resistor R2 disposed near the electron gun assembly within the tube. The fourth grid G4 is supplied with a voltage substantially equal to the voltage applied to the fifth grid G5.

The cathodes K (R, G, B) arranged in line are disposed at regular intervals of about 5 mm.

The first grid G1 and second grid G2 are formed of thin plate-like electrodes, respectively. Three circular electron beam passage holes each with a small diameter of 1 mm or less are formed in the plate face of each of the first grid G1 and second grid G2.

The third grid G3 is formed of a cup-shaped electrode elongated in the tube axis direction Z. Three electron beam passage holes each with a relatively large diameter of about 2 mm are formed in that end face of the cup-shaped electrode, which is opposed to the second grid G2. Three circular electron beam passage holes each with a large diameter of about 3 to 6 mm are formed in that end face of the cup-shaped electrode, which is opposed to the fourth grid G4, as shown in FIG. 7.

Figure 7:
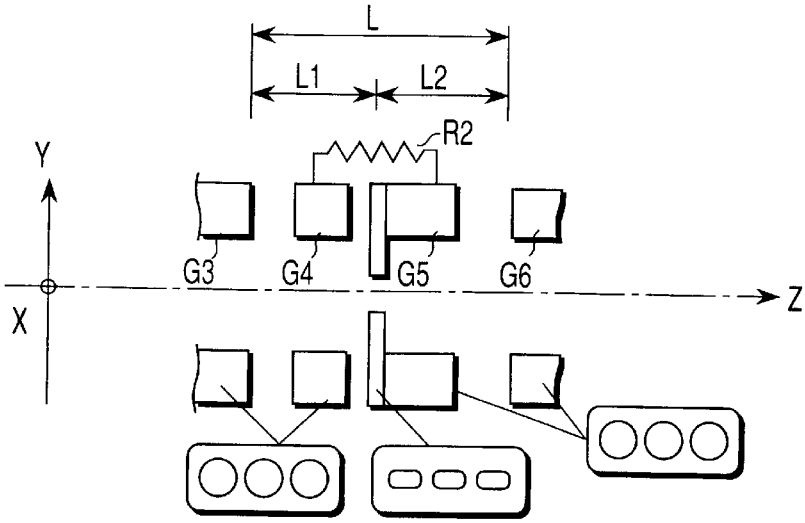
FIG. 7 is a vertical cross-sectional view showing the positional relationship between the third to sixth grids of the electron gun assembly shown in FIG. 6 and the shapes of electron beam passage holes in the grids.

The fourth grid G4 is formed of a thick plate-like electrode, as shown in FIG. 7. This plate-like electrode has three circular electron beam passage holes each with a large diameter of about 3 to 6 mm.

The fifth grid G5 is composed of a thin plate-like electrode and a thick plate-like electrode, as shown in FIG. 7. The plate-like electrode facing the fourth grid G4 has three horizontally elongated non-circular electron beam passage holes each having a major axis in the horizontal direction X. The horizontal dimension of each of the three electron beam passage holes is about 3 to 6 mm, which is substantially equal to the diameter of each of the electron beam passage holes formed in the fourth grid G4. The plate-like electrode facing the sixth grid G6 has three circular electron beam passage holes each with a large diameter of about 3 to 6 mm.

The sixth grid G6 is formed of a cup-shaped electrode elongated in the tube axis direction Z. Three electron beam passage holes each with a large diameter of about 3 to 6 mm are formed in that end face of the cup-shaped electrode, which is opposed to the fifth grid G5, as shown in FIG. 7. Three vertically elongated non-circular electron beam passage holes each having a major axis in the vertical direction Y are formed in that end face of the sixth grid G6, which is opposed to the seventh grid G7.

The seventh grid G7 is formed of a cup-shaped electrode elongated in the tube axis direction Z. Three horizontally elongated non-circular electron beam passage holes each having a major axis in the horizontal direction X are formed in that end face of the seventh grid G7, which is opposed to the sixth grid G6. Three circular electron beam passage holes each with a large diameter of about 3 to 6 mm are formed in that end face of the seventh grid G7, which is opposed to the intermediate electrode GM.

The intermediate electrode GM is formed of a thick plate-like electrode. This plate-like electrode has three circular electron beam passage holes each with a large diameter of about 3 to 6 mm.

The eighth grid G8 is formed of a plate-like electrode. The plate-like electrode facing the intermediate electrode GM has three circular electron beam passage holes each with a large diameter of about 3 to 6 mm.

The convergence cup G9 is welded to the eighth grid G8. The end face of the convergence cup G9 has three circular electron beam passage holes each with a large diameter of about 3 to 6 mm.

The first grid G1 and second grid G2 are opposed to each other with a very small gap of 0.5 mm or less. The second grid G2 through the eight grid G8 are disposed such that they are opposed to one another with intervals of about 0.5 to 1 mm.

As is shown in FIG. 7, an inter-electrode distance L is defined between that face of the third grid G3, which is opposed to the fourth grid G4, and that face of the sixth grid G6, which is opposed to the fifth grid G5. That face of the fifth grid G5, which is opposed to the fourth grid G4, is located at a substantially middle point (L1≈L2) of the distance L. In other words, that face of the fifth grid G5, which is opposed to the fourth grid G4, is located at a position where a potential gradient between the third grid G3 and sixth grid G6 becomes substantially zero when the AC component that produces the dynamic focus voltage is at a minimum level.

As has been described above, that face of the fifth grid G5, which is opposed to the fourth grid G4, has the horizontally elongated beam passage holes. The electron beam passage holes formed in that face of the fifth grid G5, which is opposed to the sixth grid G6, are substantially the same as those formed in that face of the sixth grid G6, which is opposed to the fifth grid G5. In addition, the electron beam passage holes formed in that face of the third grid G3, which is opposed to the fourth grid G4, are substantially the same as those formed in that face of the fourth grid G4, which is opposed to the third grid G3.

In the electron gun assembly 7 having the above-described structure, the cathodes K, first grid G1 and second grid G2 constitute an electron beam generating section for generating electron beams. The sixth grid G6 through the eighth grid G8 constitute an expansion electric field type main lens for ultimately focusing the electron beams on the phosphor screen.

At the time of deflecting the electron beams onto a peripheral portion of the phosphor screen, the third grid G3 and seventh grid G7 are supplied with the dynamic focus voltage that varies in accordance with the deflection amount of the electron beams. Thereby, quadrupole lenses, whose lens functions vary dynamically, are created between the fourth grid G4 and fifth grid G5 and between the sixth grid G6 and seventh grid G7.

More specifically, if the dynamic focus voltage is supplied to the seventh grid G7, a potential difference is provided between the sixth grid G6 and seventh grid G7. Thereby, a non-axis symmetrical lens, i.e. a first quadrupole lens, whose lens intensity varies dynamically and differs between the horizontal direction X and vertical direction Y, is created through the asymmetric electron beam passage holes formed in the sixth grid G6 and seventh grid G7. The non-axis symmetrical lens has, in a relative fashion, a divergence action in the vertical direction Y and a focusing action in the horizontal direction X.

The fourth grid G4 is supplied with part of the dynamic focus voltage, which has been supplied to the third grid G3, by superimposition via a capacitance between the third and fourth grids and a capacitance between the fourth and fifth grids. This causes a potential difference between the fourth grid G4 and fifth grid G5. Thereby, a non-axis symmetrical lens, i.e. a second quadrupole lens, whose lens intensity varies dynamically and differs between the horizontal direction X and vertical direction Y, is created through the asymmetric electron beam passage holes formed in the fourth grid G4 and fifth grid G5.

The electron beam passage holes formed in that face of the fifth grid G5, which is opposed to the fourth grid G4, are substantially equal in horizontal dimension to, and less in vertical dimension than, those formed in that face of the fourth grid G4, which is opposed to the fifth grid G5. Accordingly, the non-axis symmetrical lens created between these grids has, in a relative fashion, a focusing action in the vertical direction Y, but has no lens action in the horizontal direction X. In other words, when the dynamic focus voltage is applied to the third grid G3, the electron lens system comprising the third grid (second dynamic focus electrode) G3, fourth grid (first auxiliary electrode) G4, fifth grid (second auxiliary electrode) G5 and sixth grid (focus electrode) G6 has such a lens action as to hardly vary in the horizontal direction but as to vary to have a focusing function relatively in the vertical direction, in accordance with an increase in deflection magnetic field.

Figure 9:
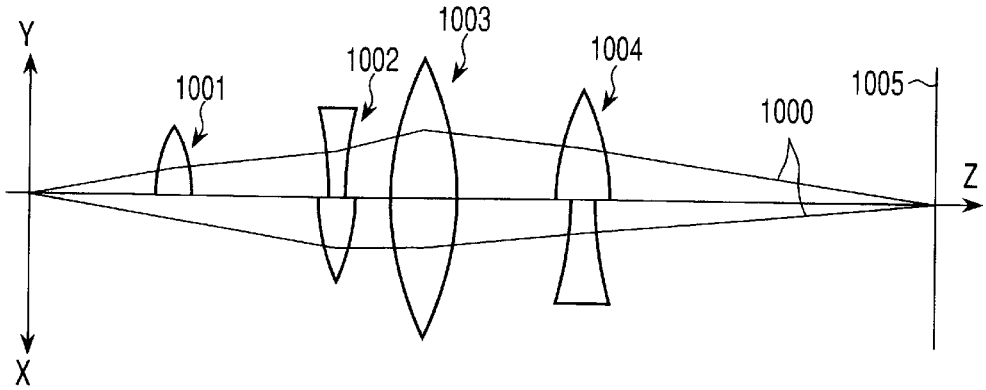
FIG. 9 shows an optical model of an electron gun assembly with a double quadrupole lens structure shown in FIG. 6.

As is shown in an optical model of FIG. 9, at the time of deflecting electron beams onto a peripheral portion of the phosphor screen, a second quadrupole lens 1001, a first quadrupole lens 1002 and a main lens 1003 are created in the electron gun assembly in the named order from the electron beam generating section side toward the phosphor screen 1005.

An electron beam 1000 generated from the electron beam generating section suffers no lens action in the horizontal direction X but suffers a focusing action in the vertical direction Y by the second quadrupole lens 1001 created between the fourth grid G4 and fifth grid G5. This electron beam 1000 suffers a focusing action in the horizontal direction X and a divergence action in the vertical direction Y by the first quadrupole lens 1002 created between the sixth grid G6 and seventh grid G7. Furthermore, the electron beam 1000 suffers a focusing action both in the horizontal direction X and vertical direction Y by the main lens 1003 created by the sixth grid G6, seventh grid G7, intermediate grid GM and eighth grid G8.

The electron beam 1000 emitted from the electron gun assembly suffers a divergence action in the horizontal direction X and a focusing action in the vertical direction Y owing to a deflection magnetic field 1004.

By virtue of the above-described structure, the electron beam 1000 can be dynamically controlled in synchronism with the deflection current supplied to the deflection yoke in the front stage of the main lens 1003. At the same time, the focusing condition of the first quadrupole lens 1002 disposed in front of the main lens 1003 can be varied. Thus, compared to the conventional dynamic focus electron gun assembly, horizontal deformation of the electron beam can be eliminated. Thereby, the electron beam can be focused more appropriately on the peripheral portion of the phosphor screen. Therefore, occurrence of moire or the like can be suppressed on the peripheral portion of the phosphor screen, and good focus characteristics can be obtained over the entire area of the phosphor screen.

Figure 3:
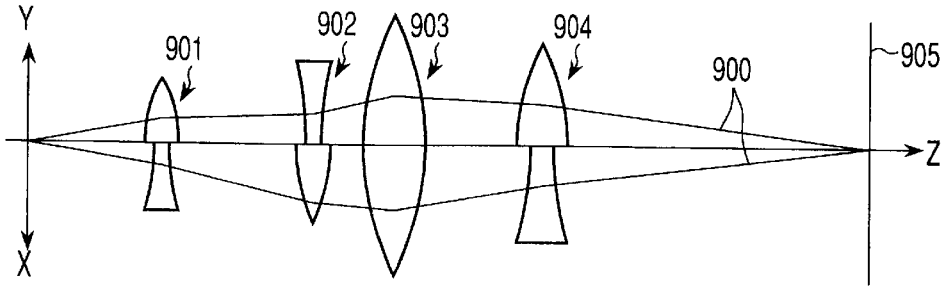
FIG. 3 (Prior art)
FIG. 3 shows an optical model of a conventional electron gun assembly with a double quadrupole lens structure.
Figure 4:
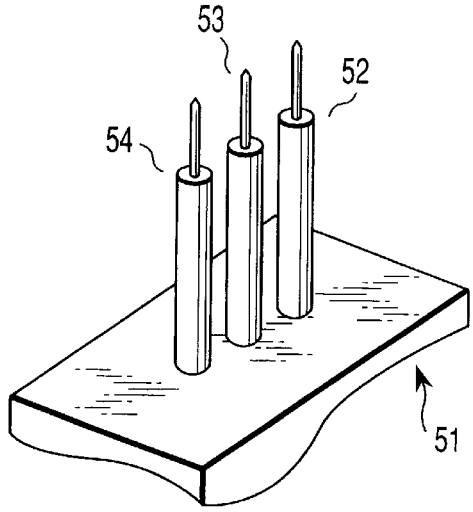
FIG. 4 schematically shows a jig to be used in fabricating an electron gun assembly.

Compared to the conventional double quadrupole lens structure as shown in FIG. 3, the electron beam focused on the peripheral portion of the phosphor screen is not affected by the horizontal lens action of the second quadrupole lens. Thus, the horizontal dimension of the electron beam hardly varies, and the beam is less affected by the spherical aberration of the main lens.

Figure 1A:
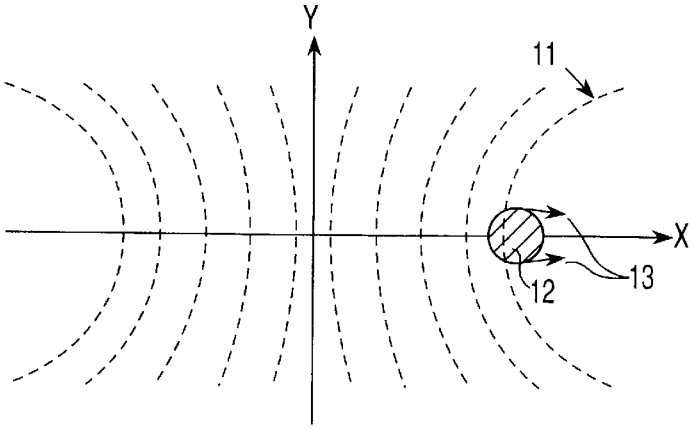
FIG. 1A (Prior art)
FIG. 1A is a view for explaining a force exerted by a non-uniform magnetic field upon an electron beam.
Figure 1B:
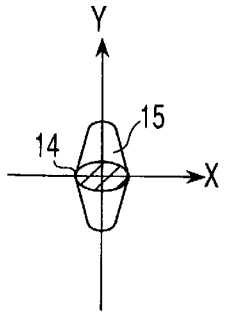
FIG. 1B (Prior art)
FIG. 1B is a view for explaining deformation of a beam spot due to a non-uniform magnetic field.
Figure 2:
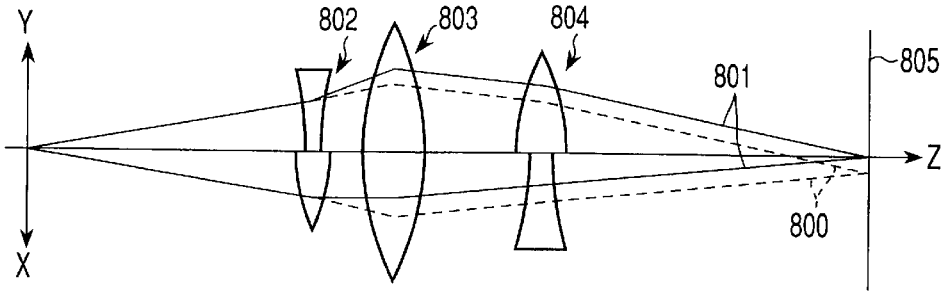
FIG. 2 (Prior art)
FIG. 2 shows an optical model of a conventional electron gun assembly capable of performing dynamic astigmatism compensation.

Besides, when the conventional structure shown in FIG. 2 is re-designed into the conventional double quadrupole lens structure shown in FIG. 3, the re-designing is complex since both the horizontal and vertical dimensions vary at the time of non-deflection when the electron beam is focused on the center portion of the phosphor screen. On the other hand, when the conventional structure shown in FIG. 2 is re-designed into the double quadrupole lens structure of this embodiment as shown in FIG. 9, the re-designing is easy since the second quadrupole lens does not function at the time of non-deflection.

In the conventional double quadrupole lens structure shown in FIG. 3, the lens operation for focus adjustment is complex and it is difficult to set an optimal focus voltage. By contrast, in the double quadrupole lens structure shown in FIG. 9, the second quadrupole lens does not function in the horizontal direction and it is thus easy to set the optimal focus voltage.

Moreover, when the electron gun assembly is manufactured, the engagement portions between the jig to be used and the electron beam passage holes in the electrodes are the same as those in the conventional electron gun assembly. That is, the horizontal dimensions of the electron beam passage holes are substantially equal in all the electrodes. Thus, there is no need to re-design the jig.

Figure 8:
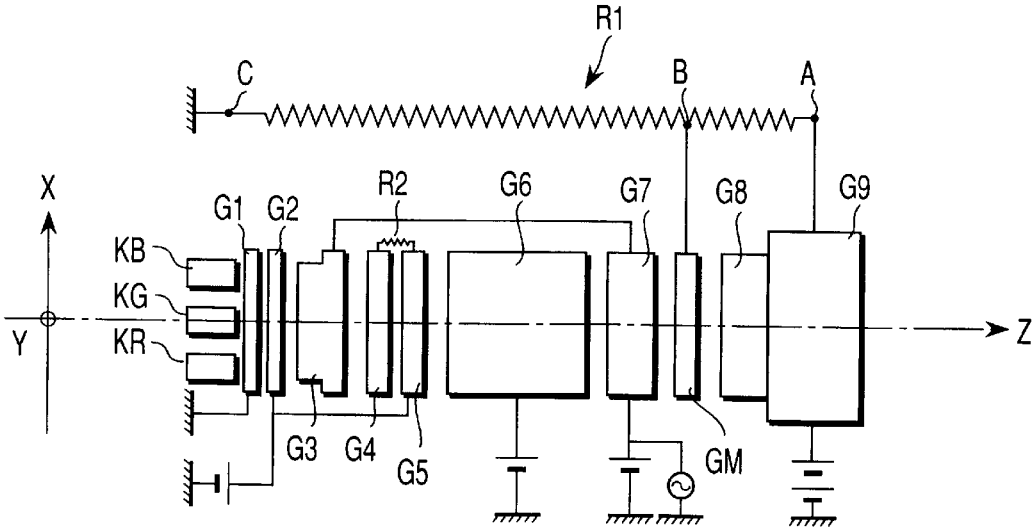
FIG. 8 is a horizontal cross-sectional view schematically showing another structure of the electron gun assembly applied to the CRT apparatus shown in FIG. 5.

In the above-described embodiment, the intermediate electrode GM and the fifth grid G5 are connected, as shown in FIG. 6. Alternatively, as shown in FIG. 8, the second grid G2 and fifth grid G5 may be connected, with the shapes of the electron beam passage holes formed in the grids being the same as shown in FIG. 6. With this structure, too, the same operational advantages are obtained.

The electron beam passage holes formed in the fifth grid G5 are asymmetric, as shown in FIG. 7. Alternatively, the electron beam passage holes in the fourth grid may be made asymmetric by disposing the fourth grid at a position where a potential gradient is substantially zero when the dynamic focus voltage is not applied.

In FIG. 6, the main lens of expansion electric field type is composed of the focus electrode G6, dynamic focus electrode G7, anode G8, and the single intermediate electrode GM disposed between the dynamic focus electrode G7 and anode G8. Alternatively, two or more intermediate electrodes GM may be disposed. The present invention is applicable to electron gun assemblies having an ordinary bi-potential main lens or a uni-potential main lens.

As has been described above, according to the embodiments of the present invention, there is provided a cathode-ray tube apparatus having an electron gun assembly, which requires no re-designing of a main lens system, can easily perform focus adjustment, requires no re-designing of a jig at the time of assembling an electron gun, and can obtain good image characteristics over the entire area of a phosphor screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus comprising:

an electron gun assembly including an electron beam generating section which generates an electron beam, and a main lens section which focus an electron beam generated from the electron beam generating section onto a phosphor screen; and a deflection yoke which generates deflection magnetic fields for deflecting and scanning the electron beam emitted from the electron gun assembly in a horizontal direction and a vertical direction, wherein the electron gun assembly includes a focus electrode supplied with a focus voltage of a first level and constituting a part of the main lens section, a first dynamic focus electrode supplied with a dynamic focus voltage obtained by superimposing an AC component, which varies in synchronism with the deflection magnetic fields, upon a reference voltage close to the first level, and constituting a part of the main lens section, a second dynamic focus electrode supplied with said dynamic focus voltage and disposed in a front stage of the main lens section, and an anode supplied with an anode voltage with a second level higher than said first level, at least two auxiliary electrodes are disposed adjacent to the second dynamic focus electrode, said at least two auxiliary electrodes are connected via a resistor disposed near the electron gun assembly, and the focus electrode and the first dynamic focus electrode are disposed adjacent to each other.

2. A cathode-ray tube apparatus according to claim 1, wherein when the dynamic focus voltage is applied to the second dynamic focus electrode, an electron lens system composed of the second dynamic focus electrode, said at least two auxiliary electrodes and the focus electrode has such a lens action as to hardly vary in the horizontal direction but as to vary to have a focusing function relatively in the vertical direction, in accordance with an increase in the deflection magnetic fields.

3. A cathode-ray tube apparatus comprising:

an electron gun assembly including an electron beam generating section which generates an electron beam, and a main lens section which focus an electron beam generated from the electron beam generating section onto a phosphor screen; and a deflection yoke which generates deflection magnetic fields for deflecting and scanning the electron beam emitted from the electron gun assembly in a horizontal direction and a vertical direction, wherein the main lens section of the electron gun assembly includes a focus electrode supplied with a focus voltage of a first level, a dynamic focus electrode supplied with a dynamic focus voltage obtained by superimposing an AC component, which varies in synchronism with the deflection magnetic fields, upon a reference voltage close to the first level, and an anode supplied with an anode voltage with a second level higher than said first level, the electron gun assembly further includes at least two auxiliary electrodes disposed between the focus electrode and the dynamic focus electrode, and said at least two auxiliary electrodes are connected via a resistor disposed near the electron gun assembly.

4. A cathode-ray tube apparatus according to claim 3, wherein one of said auxiliary electrodes is provided with non-axis symmetric lens forming means for forming a non-axis symmetric lens, which is located at a position where a potential gradient between the focus electrode and the dynamic focus electrode becomes substantially zero when the AC component that produces the dynamic focus voltage is at a minimum level.

5. A cathode-ray tube apparatus according to claim 3, wherein the dynamic focus electrode, said at least two auxiliary electrodes and the focus electrode are arranged adjacent to one another in the named order, and a non-axis symmetric lens is formed between said at least two auxiliary electrodes.

6. A cathode-ray tube apparatus according to claim 4, wherein the number of said auxiliary electrodes is two, a first auxiliary electrode of said two auxiliary electrodes, which is adjacent to the dynamic focus electrode, has a substantially circular electron beam passage hole at a surface thereof that is opposed to the dynamic focus electrode, said substantially circular electron beam passage hole being substantially the same as an electron beam passage hole formed in a surface of the dynamic focus electrode, which is opposed to the first auxiliary electrode, a second auxiliary electrode of said two auxiliary electrodes, which is adjacent to the focus electrode, has a substantially circular electron beam passage hole at a surface thereof that is opposed to the focus electrode, said substantially circular electron beam passage hole being substantially the same as an electron beam passage hole formed in a surface of the focus electrode, which is opposed to the second auxiliary electrode, and the non-axis symmetric lens forming means is formed on at least one of the face of the first auxiliary electrode, which is opposed to the second auxiliary electrode, and the face of the second auxiliary electrode, which is opposed to the first auxiliary electrode.

7. A cathode-ray tube apparatus according to claim 6, wherein the non-axis symmetric lens formed by the non-axis symmetric lens forming means has, in a relative fashion, a divergence action in the horizontal direction and a focusing action in the vertical direction, in accordance with an increase in the deflection magnetic fields.

8. A cathode-ray tube apparatus according to claim 7, wherein the non-axis symmetric lens forming means is formed by an electron beam passage hole having a greater dimension in the horizontal direction than in the vertical direction, said electron beam passage hole being formed in a surface of the second auxiliary electrode, which is opposed to the first auxiliary electrode.

9. A cathode-ray tube apparatus according to claim 8, wherein the non-axis symmetric lens forming means formed at the second auxiliary electrode is located at a substantially middle position between the surface of the dynamic focus electrode, which is opposed to the first auxiliary electrode, and the surface of the focus electrode, which is opposed to the second auxiliary electrode.

10. A cathode-ray tube apparatus according to claim 3, wherein when the dynamic focus voltage is applied to the dynamic focus electrode, an electron lens system composed of the dynamic focus electrode, said at least two auxiliary electrodes and the focus electrode has such a lens action as to hardly vary in the horizontal direction but as to vary to have a focusing function relatively in the vertical direction, in accordance with an increase in the deflection magnetic fields.

* * * * *